US008093479B2

(12) United States Patent
Schafer et al.

(10) Patent No.: US 8,093,479 B2
(45) Date of Patent: Jan. 10, 2012

(54) PERCUSSION INSTRUMENT CARRIER SYSTEM

(76) Inventors: Mark W. Schafer, Lake Geneva, WI (US); Steven P. Crouch, Highland, IL (US)

( * ) Notice: Subject to any disclaimer, the term of this patent is extended or adjusted under 35 U.S.C. 154(b) by 0 days.

(21) Appl. No.: 12/806,173

(22) Filed: Aug. 6, 2010

(65) Prior Publication Data

US 2011/0030530 A1 Feb. 10, 2011

Related U.S. Application Data

(60) Provisional application No. 61/273,622, filed on Aug. 6, 2009.

(51) Int. Cl.
*G10D 13/02* (2006.01)

(52) U.S. Cl. ..... 84/421

(58) Field of Classification Search ..... 84/421, 84/411 R

See application file for complete search history.

(56) References Cited

U.S. PATENT DOCUMENTS

| | | | |
|---|---|---|---|
| 241,195 | A | 5/1881 | Cubley |
| 3,106,123 | A | 10/1963 | Johannsen |
| 3,974,732 | A | 8/1976 | Kester |
| 4,256,007 | A | 3/1981 | Streit |
| 4,387,839 | A | 6/1983 | Dranchak |
| 4,402,441 | A | 9/1983 | Jones |
| 4,448,105 | A | 5/1984 | Cordes |
| 4,450,993 | A | 5/1984 | Ephraim |
| 4,453,442 | A | 6/1984 | LaFlame |
| 4,605,144 | A | 8/1986 | LaFlame |
| 4,634,032 | A | 1/1987 | LaFlame |
| 4,715,293 | A | 12/1987 | Cobbs |
| 4,799,610 | A | 1/1989 | Hsieh |
| 5,072,910 | A | 12/1991 | May |
| 5,309,810 | A | 5/1994 | May |
| 5,400,683 | A | 3/1995 | LaFlame |
| 5,477,767 | A | 12/1995 | May |
| 5,520,292 | A | 5/1996 | Lombardi |
| 5,573,158 | A | 11/1996 | Penn |
| 5,691,492 | A | 11/1997 | May |
| 5,973,247 | A | 10/1999 | Matthews |
| 6,028,257 | A | 2/2000 | May |
| 6,172,290 | B1 | 1/2001 | May |
| 6,245,980 | B1 | 6/2001 | May |
| 6,323,407 | B1 | 11/2001 | May |
| 6,329,583 | B1 | 12/2001 | May |
| 6,403,869 | B2 | 6/2002 | May |
| 6,770,805 | B2 | 8/2004 | May |
| 6,881,886 | B2 | 4/2005 | May |
| 7,071,401 | B2 | 7/2006 | May |
| 7,166,790 | B2 | 1/2007 | May |
| 7,326,842 | B2 | 2/2008 | May |
| 7,394,008 | B2 | 7/2008 | May |
| 7,420,110 | B2 | 9/2008 | May |
| 7,438,266 | B2 | 10/2008 | May |
| 7,588,228 | B2 | 9/2009 | May |
| 7,673,776 | B2 | 3/2010 | May |
| 7,810,684 | B2 | 10/2010 | May |
| 7,812,235 | B2 | 10/2010 | May |
| 2005/0183565 | A1 * | 8/2005 | May ..... 84/421 |
| 2007/0095193 | A1 | 5/2007 | May |
| 2009/0045235 | A1 | 2/2009 | May |
| 2010/0154617 | A1 | 6/2010 | May |

* cited by examiner

*Primary Examiner* — Kimberly Lockett
(74) *Attorney, Agent, or Firm* — Douglas E. Warren

(57) ABSTRACT

A percussion instrument carrier system for carrying percussion instruments by members of a marching band. A preferred embodiment of the percussion instrument carrier system includes an interlock mechanism that provides for one of either mounting the percussion instrument onto the percussion instrument carrier or dismounting the percussion instrument from the percussion instrument carrier by only the manipulation of the percussion instrument in relation to the percussion instrument carrier as needed to respectively and operatively engage or disengage components of the interlock mounting system.

49 Claims, 6 Drawing Sheets

PERCUSSION INSTRUMENT CARRIER SYSTEM

CROSS REFERENCE TO RELATED APPLICATIONS

This application claims the benefit of U.S. Provisional Application No. 61/273,622 filed on Aug. 6, 2009. The entire disclosure of that application is incorporated by reference into the disclosure of this document is if fully stated herein.

STATEMENT REGARDING FEDERALLY SPONSORED RESEARCH

Not Applicable.

FIELD

This present disclosure relates to a percussion instrument carrier system, and more specifically to a system for carrying percussion instruments.

BACKGROUND

This section provides background information related to the present disclosure which is not necessarily prior art.

Musicians in a marching band carry a wide variety of band instruments. Such instruments include trumpets, comets, trombones, and percussion instruments. Percussion instruments include any of a number of instruments that generate musical sounds when the instrument is struck. Drums of various sizes ranging from tom-toms to very large bass drums are included in that class.

When drums are being played within a marching band, the percussionist playing the drum must carry the drum in such a manner that allows the percussionist to comfortably play and carry the drum while simultaneously marching. The marching process can include marching long distances and marching together with other band members to generate complex patterns that cover hundreds of square feet of marching area.

Although there are a number of drum carrier inventions, there is still a need to provide a drum carrier that is comparatively lightweight, but still stable enough to provide a firm support for the drum to be played by the percussionist. Additionally, there should be adjustments on the drum carrier that allow the percussionist to match the various positional preferences each percussionist may have for positioning the percussion instrument in the manner each individual percussionist deems best for the percussionist's particular style and mannerism of playing the drum.

Finally it is also important to provide a drum carrier system that permits the quick installation and removal of the percussion instrument onto and off of the drum carrier portion without the need for constant readjustment of the percussion instrument mounted onto the drum carrier portion.

SUMMARY

This section provides a general summary of the disclosure, and is not a comprehensive disclosure of its full scope or all of its features.

In accordance with the various embodiments of the present invention, a new type of percussion instrument carrier system is disclosed herein that provides an interlock mounting system for attaching a percussion instrument to a percussion instrument carrier. The interlock mounting system of certain embodiments of the present invention includes a mounting mechanism that has fewer components and substantially reduces the need for repeated readjustment when the percussion instrument is being carried by the percussion instrument carrier. The interlock mounting system also provides a unique means of installing and removing the percussion instrument onto and off of the percussion instrument carrier in a substantially rapid manner.

It is well-known that there are two primary configurations of percussion instrument carriers: vest type drum carriers and T-bar type drum carriers. The T-bar type drum carrier gets its name from the general shape of the assembled components of T-bar type drum carrier. More specifically, in a T-bar type drum carrier, the front of the drum carrier includes a generally horizontal bar attached to a set of shoulder supporting elements, and also includes a generally vertical bar attached at its top portion to the longitudinal center of the generally horizontal bar. The generally vertical bar then attaches at its bottom portion to a belly plate upon which drum attachment mechanisms are mounted. The overall arrangement of the horizontal bar and the vertical bar are reminiscent of the letter "T" thus giving this type of percussion instrument carrier its name of "T-bar type" carrier. It is understood that the device disclosed herein is a T-bar type percussion instrument carrier.

Further areas of applicability will become apparent from the description provided herein. The description and specific examples in this summary are intended for purposes of illustration only and are not intended to limit the scope of the present disclosure.

DESCRIPTION OF THE DRAWINGS

The drawings described herein are for illustrative purposes only of selected embodiments and not all possible implementations, and are not intended to limit the scope of the present disclosure.

In the accompanying drawings which form part of the specification.

Corresponding reference numerals indicate corresponding steps or parts throughout the several figures of the drawings.

While one embodiment of the present invention is illustrated in the above referenced drawings and in the following description, it is understood that the embodiment shown is merely one example of a single preferred embodiment offered for the purpose of illustration only and that various changes in construction may be resorted to in the course of manufacture in order that the present invention may be utilized to the best advantage according to circumstances which may arise, without in any way departing from the spirit and intention of the present invention, which is to be limited only in accordance with the claims contained herein.

DETAILED DESCRIPTION OF AT LEAST ONE PREFERRED EMBODIMENT OF THE INVENTION

In the following description, numerous specific details are set forth such as examples of specific components, devices, methods, in order to provide a thorough understanding of embodiments of the present disclosure. It will be apparent to a person of ordinary skill in the art that these specific details need not be employed, and should not be construed to limit the scope of the disclosure. In the development of any actual implementation, numerous implementation-specific decisions must be made to achieve the developer's specific goals, such as compliance with system-related and business-related constraints. Such a development effort might be complex and time consuming, but is nevertheless a routine undertaking of design, fabrication and manufacture for those of ordinary skill.

A preferred embodiment of the percussion instrument carrier system of the present invention is illustrated in FIG. 1 through FIG. 9.

Figure 1:
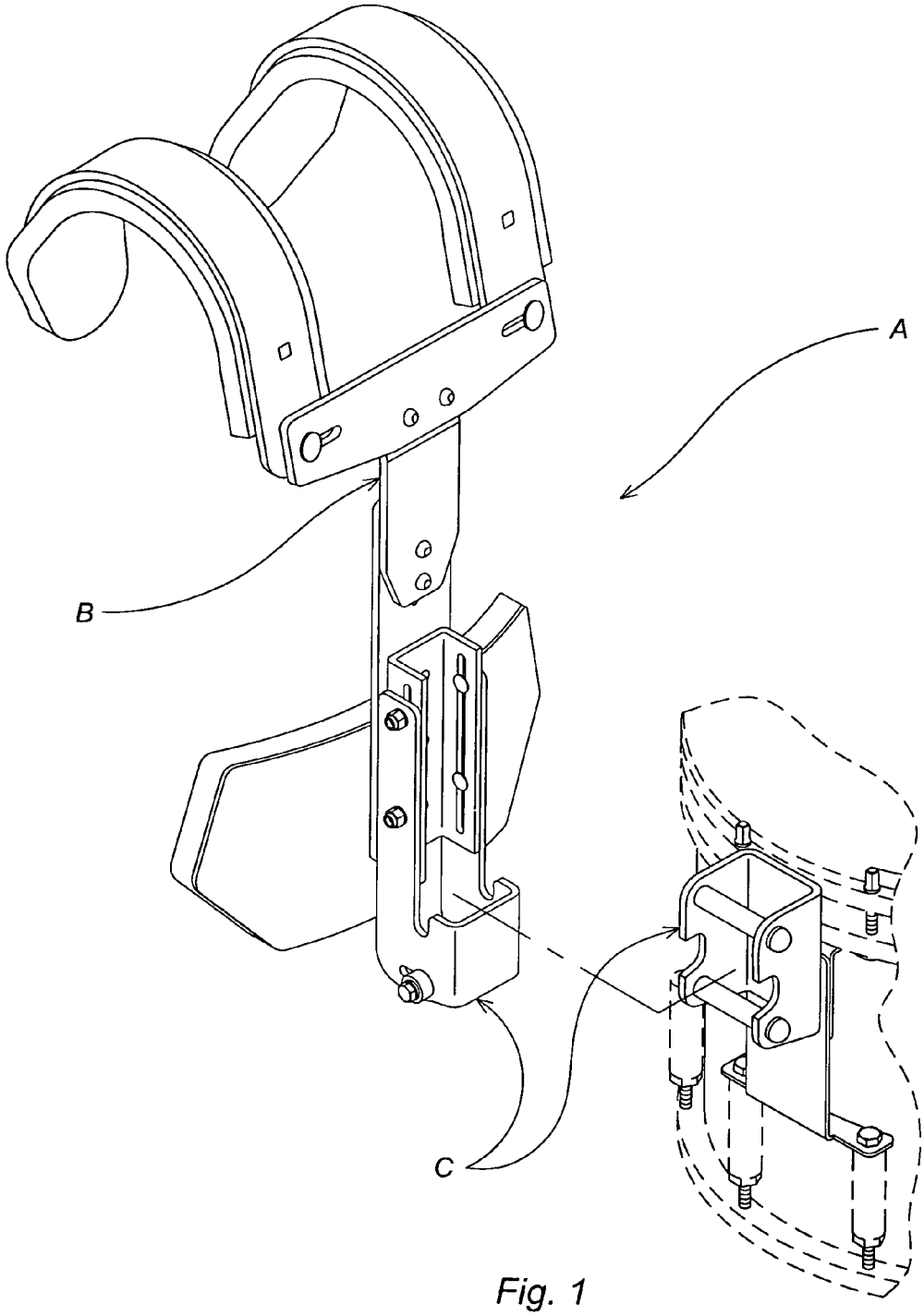
FIG. 1 shows a front perspective few of one embodiment of the present invention.

Referring to FIG. 1, the percussion instrument carrier system A comprises a drum carrier B and an interlock mounting system C for attaching a percussion instrument onto the percussion instrument carrier system A. The drum carrier B includes a set of shoulder supporting elements 1, a T-bar assembly 2, and a belly plate 3. The T-bar assembly includes a horizontally mounted member 5 and a vertically mounted member 6. The set of shoulder supporting elements 1 are operatively connected to the horizontally mounted member 5 by attachment of the set of shoulder supporting elements to the horizontally mounted member 5. In one embodiment of the present invention, the set of shoulder supporting elements 1 is attached to the horizontally mounted member 5 with fasteners. In yet other embodiments, the set of shoulder supporting elements 1 are welded to the horizontally mounted element 5. It is understood that when fasteners are used, the fastener mounting openings can be have various geometric shapes to either match the type of fastener used or to allow for adjustment of the connection between the set of shoulder support elements 1 and the horizontally mounted member 5.

The set of shoulder supporting elements 1 of the percussion instrument carrier system A have a unique design on the end portion 47 (FIG. 2) of each of the set of shoulder supporting elements. More specifically, the end portion 47 is set at an angle in relation to the remainder of each of the set of shoulder supporting elements 1. That is to say, the longitudinal axis of the end portion 47 is set at an angle of between about 25 degrees and about 45 degrees in relation to the longitudinal axis of the remainder of each of the set of shoulder supporting elements 1. This angular relationship between the longitudinal axis of the end portion 47 and the longitudinal axis of each of the shoulder supporting elements 1 exists for at least two purposes. First, the angular style of each of the shoulder supporting elements 1 enhances the aesthetic appearance of the shoulder supporting element and the percussion instrument carrying system A. Second, the angular style shoulder supporting element 1 is intended to increase the comfort and general stability of the shoulder supporting element when in use on the shoulders of a user.

In the present embodiment, the vertically mounted member 6 is disposed next to the horizontally mounted member 5 by intersecting the horizontally mounted member near the longitudinal centerline of the length of the horizontally mounted member. In certain embodiments, the vertically mounted member 6 is attached to the horizontally mounted member 5 by welding the two members together. In other embodiments, the vertically mounted member 6 is attached to the horizontally mounted member 5 by using fasteners to attach the two members together.

It is noted than in certain embodiments of the present invention, the vertically mounted member 6 comprises more than a single continuous element. More specifically, the vertically mounted member 6 can be a sub-assembly that comprises two or more sub-members that can work operatively together to allow the overall vertical height of the vertically mounted member sub-assembly to be varied.

Figure 2:
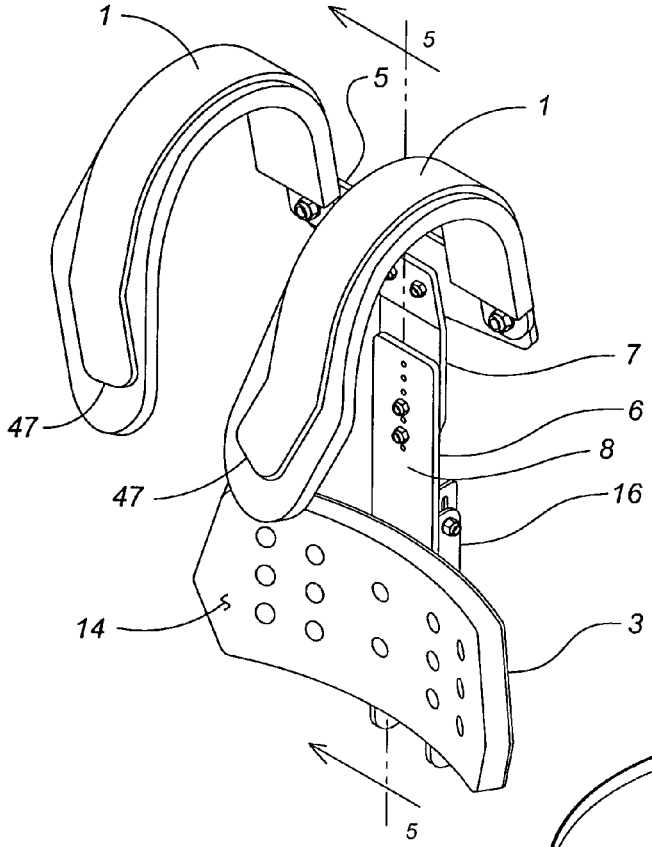
FIG. 2 shows a rear perspective view of one embodiment of the present invention.
Figure 4:
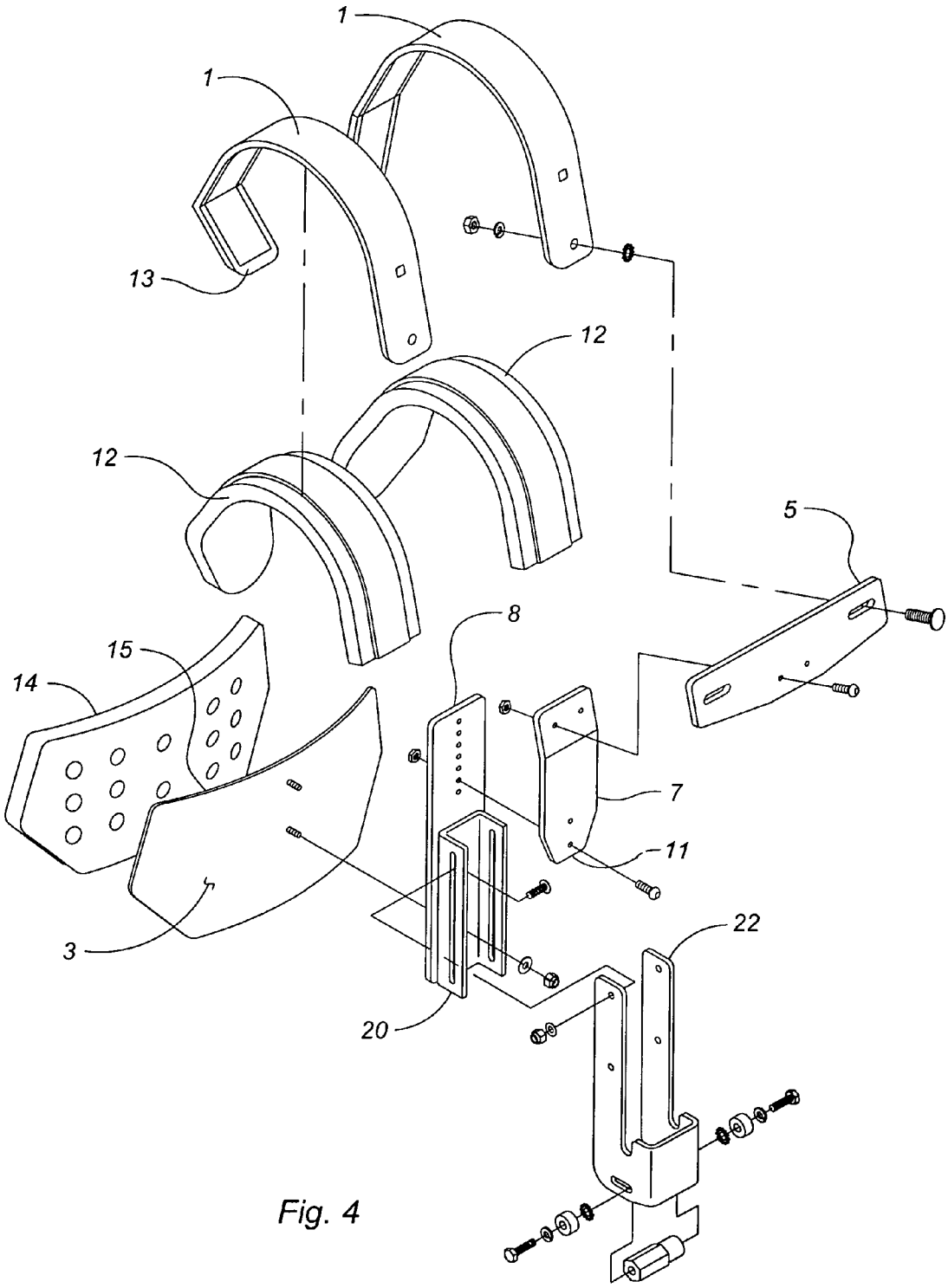
FIG. 4 shows an exploded view of the drum carrier portion of one embodiment of the present invention.

This embodiment is shown in FIG. 1, FIG. 2, and FIG. 4. In that embodiment, the vertically mounted member subassembly 6 comprises an upper vertical member 7 and a lower vertical member 8. The lower vertical member 8 includes a first set of mounting openings 9 (FIG. 4) that substantially matches a second set of mounting openings 10 located in the upper vertical member 7. It is noted that in the present embodiment, the number of openings in the first set of mounting openings 9 is greater than the number of openings in the second set of mounting openings 10. It is also noted that the spacing between each of the openings in the first set of mounting openings 9 and the spacing between the openings in the second set of mounting openings 10 are substantially the same. Those of skill in the art will understand that the sameness in the spacing between the two sets of mounting openings 9 and 10 allow the vertically mounted sub-assembly 6 to be adjusted to lengthen or shorten the overall length of the vertically mounted sub-assembly in increments equivalent to the spacing of the openings in each of the two sets of mounting openings 9 and 10. This ability to adjust the overall length of the vertically mounted sub-assembly 6 allows the user of the percussion instrument carrying system A to adjust the position of the percussion instrument 17 on the percussion instrument carrying system. When the user has matched a chosen set of openings from the first set of mounting openings 9 with openings in the second set of mounting openings 10, fasteners are installed into at least two of the matched set of mounting openings. The installation of these fasteners establishes the overall length of the vertically mounted sub-assembly 6 as chosen by the user.

The vertically mounted member 6 (FIG. 1) is disposed near the belly plate 3 by placing the lower portion 11 of the vertically mounted member near the belly plate. In certain embodiments, the belly plate 3 and the vertically mounted member 6 are welded together. In other embodiments, the belly plate 3 is attached to the vertically mounted member 6 by fasteners as shown in FIG. 4.

In some embodiments of the percussion instrument carrying system A, the set of shoulder supporting elements 1 has shoulder support element padding 12 mounted to the underside surface 13 of the shoulder supporting element. Additionally, in yet other embodiments, belly plate padding 14 is mounted onto the inner surface 15 of the belly plate that will rest next to the abdomen of the percussionist using the percussion instrument carrying system A. In other embodiments of the present invention, no padding is used on either the set of shoulder supporting elements 1 or the belly plate 3.

The shoulder support element padding 12 and the belly plate padding 14 in some embodiments of the present invention are made from a generally resilient material such as, for example, closed cell foam or open cell foam material. It is understood that any material may be used in the manufacture of the either the shoulder support element padding 12 or the belly plate padding 14 as long as the material selected is resilient and durable enough to withstand the environment that exists where a percussion instrument carrier is used—including the wide variation temperature and humidity, and the heavy wear associated with the use of the percussion instrument carrying while the user is marching in a band.

The method of attachment of the shoulder support element padding 12 and the belly plate padding 14 may be of any type as long as the padding does not unexpectedly detach from the mounting surface during use or transportation of the percussion instrument carrying system A. In some embodiments, the padding can be attached by use of a sufficient adhesive. In yet other embodiments, the padding can be attached using hook and loop fasteners. In the present embodiment, the belly plate padding 14 is attached to the belly plate 3 with an adhesive, while the shoulder support element padding 12 is attached to the set of shoulder support elements 1 with hook and loop fasteners.

It is also noted that that the padding can be of any shape and thickness as long as the padding sufficiently functions as a cushion between any element of the percussion instrument carrying system A and the body of the user. In some embodiments, the padding will be in the general shape of element of the percussion instrument carrying system A to which the padding is attached. In yet other embodiments, the padding can be larger or smaller than the shape of the element of the percussion instrument carrying system A to which the element is attached. In the present embodiment shown in FIG. 1 and FIG. 2, the padding is a combination of those shapes. More specifically, the shoulder support element padding 12 is shaped such that the ends of the padding generally match the width of the shoulder supporting element 1, while being dimensionally wider than the width of the shoulder support element at the point where the shoulder support element rest upon the upper shoulder of the user of the percussion instrument carrying system A. Because the shoulder support element padding 12 is wider at that point, the shoulder support element padding provides greater resistance to edge deformation or padding compaction that could allow the sharper edges of the set of shoulder support element 1 to gouge the skin of the percussion instrument carrying system A user at the user's shoulders.

The interlock mounting system C (FIG. 2 and FIG. 3) of the present embodiment comprises two sub-components: a drum carrier portion of the interlock mounting system 16 and a percussion instrument portion of the interlock mounting system 17. Referring to FIG. 4, the drum carrier portion of the interlock mounting system 16 is generally mounted to the lower vertical member 8 of the vertically mounted member 6. The drum carrier portion of the interlock mounting system 16 includes a first bracket element 20 that is in the general shape of a channel having two flanges 18 and a web 19. Each of the two channel flanges 18 includes at least one slotted mounting opening 21 positioned generally parallel to the longitudinal axis of the first bracket element 20. The first bracket element 20 is attached to the belly plate 3. While the first bracket element 20 in the present embodiment is attached to the lower portion 11 of the lower vertical member 7 with fasteners, in other embodiments, the interior channel element is welded to the lower vertical member.

Figure 9:
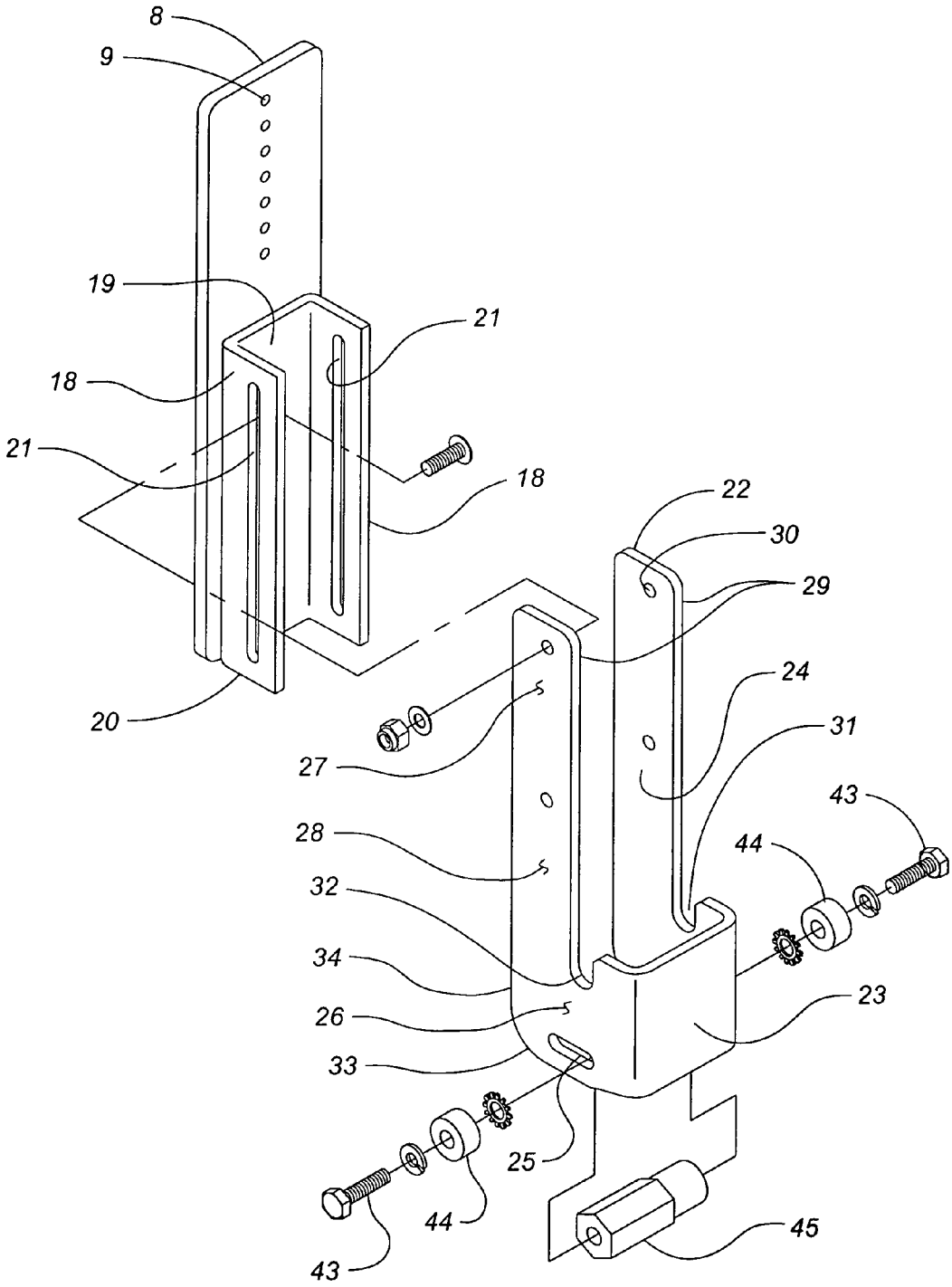
FIG. 9 shows an exploded view of the drum carrier portion of the interlock mounting system of one embodiment of the present invention.

The drum carrier portion of the interlock mounting system 16 also includes a second bracket element 22 as shown in FIG. 4 and FIG. 9. The second bracket element 22 has a web portion 23 and two flange portions 24. Each of the two flange portions 24 has a series of slots, cutouts, curved edges, and openings that allow the second bracket element 22 to operatively cooperate with components of the percussion instrument portion of the interlock mounting system 17 (FIG. 2) to allow for the mounting and removal of a percussion instrument from the percussion instrument carrying system A.

More specifically, FIG. 4 and FIG. 9 show the configuration of one of the two flange portions 24 of the second bracket element 22. The flange portion 24 includes a curved slotted opening 25 located near the proximal end 26 of the second bracket element 22. The curved slotted opening 25 in the present embodiment is somewhat perpendicular to the longitudinal surface 28 of the flange portion 24. The distal end 27 of the flange portion 24 includes a plate portion 29 that has at least one fastener opening 30. A first cutout 31 is located in the flange portion between the proximal end 26 and the distal end 27. In the present embodiment, the first cutout 31 has a width of about 0.5 inches and a radius end 32.

The proximal end 26 (FIG. 4 and FIG. 9) of the flange portion 24 also includes an arcuate portion 33 that extends from an outer edge 34 to the point of intersection of the flange portion with the web portion 23. The arcuate portion 33 in the present embodiment has a general cam-like shape where the more linear segment of the cam-like shape occurs near the intersection point of the flange portion 24 with the web portion 23 while the smaller radius portion of the cam-like shape occurs at the outer edge 34 of the flange portion 24.

When assembled, the second bracket element 22 (FIG. 1, FIG. 4 and FIG. 5) is disposed against the first bracket element 20 such that the interior channel element is generally positioned between the interior surfaces of the two flange portions 24 of the exterior bracket element. Once positioned, the second bracket element 22 is further positioned such that the at least one fastener opening 30 of the exterior bracket element generally aligns with the at least one slotted mounting opening 21 in the first bracket element 20, and then the interior channel element is fastened to the second bracket element 22 with fasteners.

The assembly of the drum carrier portion of the interlock mounting system 16 (FIG. 9) is completed by the installation of a bracing rod assembly into the curved slotted openings 25 of the two flange portions 24 of the second bracket element 22. The rod bracing assembly includes fasteners 43, two thrust washers 44, and a hexagonal rod 45 having an internal threaded portion on each end of the hexagonal rod. Installation of the bracing rod assembly is accomplished by inserting the hexagonal rod 45 between the two flange portions 24 of the second bracket element 22, placing each of the two thrust washers 44 onto each of the two fasteners 43, and then installing the two fasteners into internal threaded portions of the hexagonal rod to captivate the hexagonal rod between the two flanges 24 of the second bracket element 22 and to fix each of the two thrust washers 44 on the outside surfaces of each of the two flange portions 24 of the exterior bracket element.

It will be appreciated by those of skill in the art that the configuration and relationship between the first bracket element 20 and the second bracket element 22 may reversed. This is to say, in the above embodiment, the first bracket element 20 is made to fit within the second bracket element 22, however, in alternative embodiments, the first bracket element 20 and the second bracket element 22 may be sized and configured such that the second bracket element 22 is capable of being operatively disposed within the first bracket element 20. Regardless of which element is generally disposed outside or inside of the other element 20 or 22, all such embodiments are intended to be within the scope of the present invention.

Figure 6:
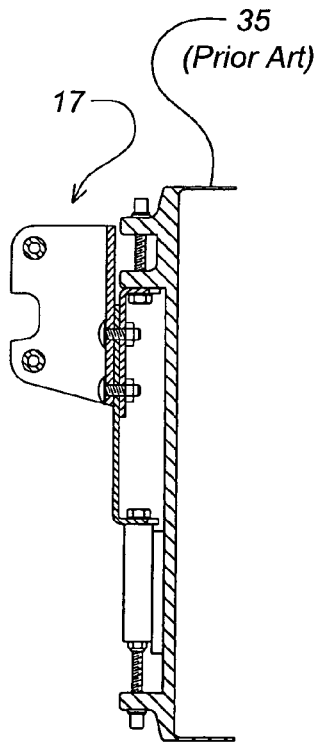
FIG. 6 shows a vertical section view the percussion instrument element of one version of the interlock mounting system of the drum carrier portion embodiment of the present invention.
Figure 7:
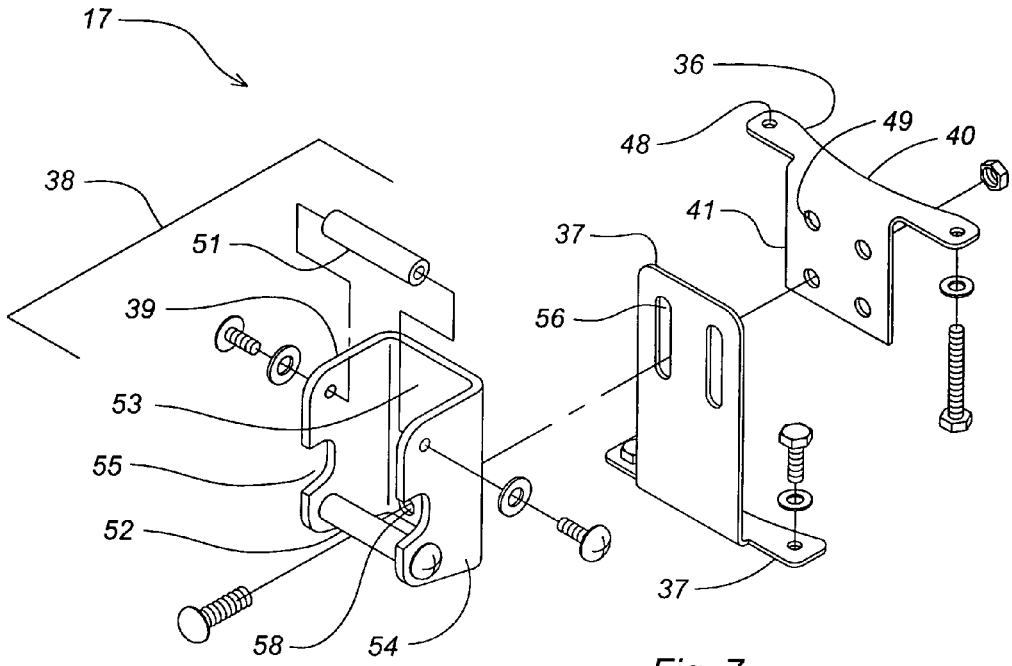
FIG. 7 shows an exploded view of the percussion instrument portion of one version of the interlock mounting system of one embodiment of the present invention.

The percussion instrument portion of the interlock mounting system 17 is shown in FIG. 1, FIG. 6, and FIG. 7. As can be seen in those figures, the percussion instrument portion of the interlock mounting system 17 attaches to the percussion instrument 35 and, when installed on the percussion instrument, certain elements of the percussion instrument portion of the interlock mounting system are designed to match and generally interlock with certain elements of the drum carrier portion of the interlock mounting system 16 mounted on the drum carrier portion of the percussion instrument carrying system A.

The percussion instrument portion of the interlock mounting system 17 (FIG. 7) comprises an upper bracket 36, a lower bracket 37, and an interlock assembly 38. The upper bracket 36 is generally L-shaped and includes a first set of mounting openings 48 in the first leg 40 and a set of second mounting openings 49 in the second leg 41. The lower bracket 37 is also generally L-shaped and includes at least one slotted mounting opening 56.

Figure 8A:
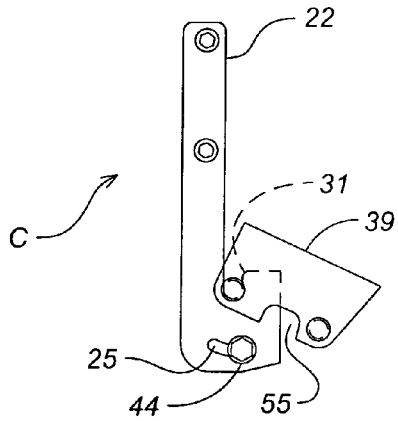
FIGS. 8A, 8B, and 8C show one version of the interlock mounting system and how the percussion instrument portion of the interlock mounting system generally interlocks with the drum carrier portion of the interlock mounting system of one embodiment of the present invention.
Figure 8B:
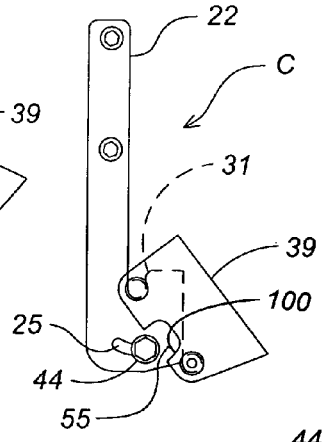
Figure 8C:
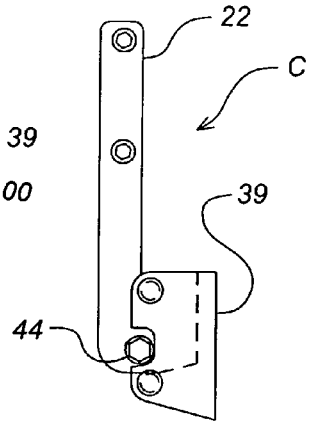

The interlock assembly 38 comprises an interlock receiver 39, a first brace rod 51, a second brace rod 52, and a set of mounting fasteners that attach the first and second brace rods to the interlock receiver 39. The interlock receiver 39 is generally channel-shaped having a web portion 53 and two flanges 54. Each of the two flanges 54 has a second cutout 55 such that the cutout in one of the flanges is in general alignment with the cutout in the other flange of the interlock receiver 39. The web portion 53 includes at least one bracket mounting opening 58. In the present embodiment, the second cutout 55 is shaped and configured to allow the cutout to operatively accept the thrust washers 44 as shown in FIGS. 8A, 8B, and 8C. Additionally, the first brace rod 51 is configured and sized to be received by first cutout 31 of the second bracket element 22 of the carrier instrument mechanism 16 and the second brace rod is configured and sized to slideably interface with the arcuate portion of the second bracket element 22.

Figure 3:
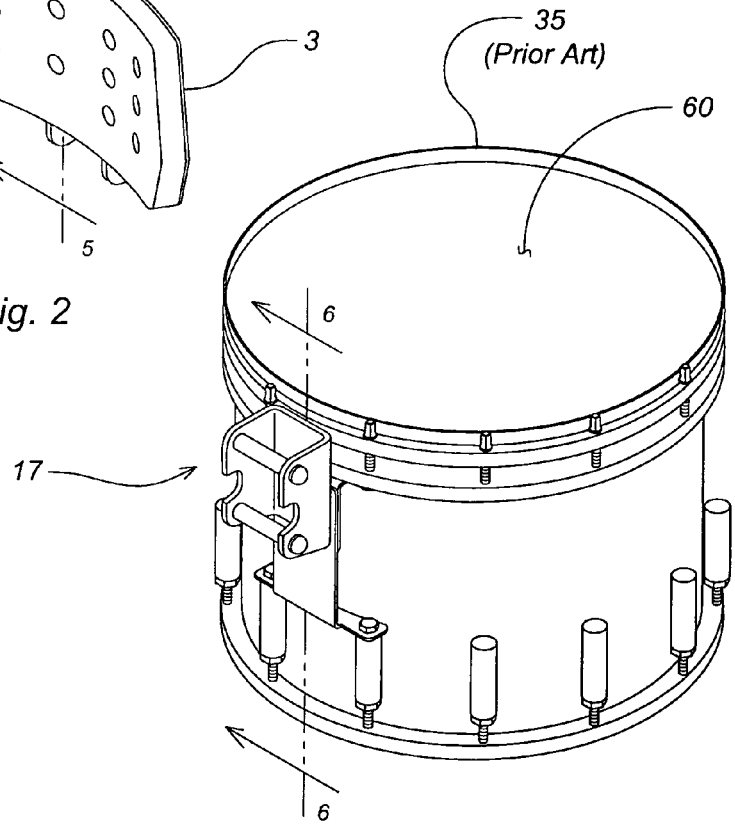
FIG. 3 shows a representative view of one type of percussion instrument that can be used with various embodiments of the present invention.

The percussion instrument portion of the interlock mounting system 17 of the present embodiment is attached to a percussion instrument 35 generally as shown in the embodiment indicated in FIG. 3 and FIG. 6. In that embodiment, the upper bracket 36 and the lower bracket 37 are installed onto the percussion instrument 35 with fasteners. It is understood that during such an installation, the at least one slotted mounting opening 56 of the lower bracket 37 is substantially aligned with the second set of mounting openings 49 of the upper bracket 36 and the at least one bracket mounting opening 58 in the interlock receiver 39, and then fasteners are installed into the aligned openings to assemble the upper bracket, the lower bracket, and the interlock bracket together.

In an alternative embodiment of the present invention, the interlock mounting system C still comprises two sub-components: a drum carrier portion 16 and a percussion instrument portion 17 of the interlock mounting system C as generally depicted in FIG. 2 through FIG. 9 and as generally described above. However, the operative relationship between certain components of the interlock mounting system C can be is different.

More specifically, the above description of the interlock mounting system C describes a system wherein the percussion instrument portion 17 engages the percussion instrument carrier portion 16 in a manner that generally incorporates a cam-lock like engagement that is the result of contact between the second brace rod 52 and the arcuate portion 33 of the second bracket element 22. This is to say, in the above embodiment, as the second brace rod 52 moves over the arcuate portion 33 toward the belly plate 3 as generally depicted in FIGS. 8A, 8B, and 8C, the second brace rod 52 reaches a point where the arcuate portion 33 biases the second brace rod 52 toward the belly plate in a manner that tends to operatively retain the percussion instrument portion 17 in relation to the percussion instrument carrier portion 16. That same bias tends to retain the first brace rod 51 into the first cutout 31 of the second bracket element 22. Thus, in the above embodiment, the engagement of the components of the percussion instrument carrier portion 16 and the percussion instrument portion 17 of the interlock mounting system C can tend to result in a generally rigid connection between the percussion instrument carrier system A and the percussion instrument 35.

In the alternative embodiment, there is substantially no cam lock-type engagement of the components of the percussion instrument carrier portion 16 and the percussion instrument portion 17 of the interlock mounting system C. That is, when the percussion instrument portion 17 and the percussion instrument carrier portion 16 are operatively engaged to mount the percussion instrument 35 onto the percussion instrument carrier system A, there is no need for the second brace rod 52 to be in biasing contact with the arcuate portion 33. Instead, during the mounting of the percussion instrument onto the percussion instrument carrier system A, the first brace rod 51 is disposed within the first cutout 31 and the percussion instrument 35 is rotated generally as depicted in FIGS. 8A, 8B, and 8C. The rotation continues until a slanted edge of the second cutout 55 comes into contact with the two thrust washers 44 of the percussion instrument carrier portion 16. Then, as the percussion instrument 35 is further rotated as depicted in FIG. 8C, the slanted edge 100 biases the first brace rod 51 deeper in to the second cutout 55 to generally retain the percussion instrument portion 17 of the interlock mounting system C onto the percussion instrument carrier portion 16. The second brace rod 52 is not specifically required to contact the arcuate portion 33 and a gap may exist between the second brace rod 52 and the arcuate portion 33. As such, the second brace rod 52 acts to generally inhibit the upward motion of the percussion instrument portion 17 in relation to the percussion instrument carrier portion 16 and the weight of the percussion instrument tends to continually bias the slanted edge 100 against the two thrust washers 44 and thereby generally maintain the percussion instrument onto the percussion instrument carrier system A.

As noted, the present alternative embodiment does not necessarily require a cam lock-type engagement between the second brace rod 52 and the arcuate portion 33, and that there may be a gap between the second brace rod 52 and the arcuate portion 33. However, while no specific cam lock-type engagement is specifically required between second brace rod 52 and the arcuate portion 33 in certain embodiments, a cam lock-type engagement may still exist and remain within the scope of the alternative embodiment.

It will be appreciated by those skilled in the art that other embodiments of the present invention may use similar methods of attaching the percussion instrument portion of the interlock mounting system 17 to a percussion instrument while still remaining within the intended scope of the present invention. For example, while the present embodiment includes the upper bracket 36 and the lower bracket 37 to provide a method of connecting the interlock receiver 39 to a percussion instrument, in yet other embodiments the method of connecting the interlock bracket to a percussion instrument may be different. In fact, the method of connecting other the interlock receiver 39 to the types of percussion instrument may include a mounting bar disposed in an intermediate position between the percussion instrument and the interlock bracket. This example could be use when a plurality of percussion instruments are grouped together on a percussion instrument mounting assembly that would allow the group of percussion instruments to be carried by a single musician. A more specific example could be a set of two or more drums that are mounted in a multiple drum carrier assembly. To allow for that multiple drum carrier assembly to use the interlock assembly of the present invention, those skilled in the art would understand that various brackets, fasteners and intermediate mounting devices can be designed to allow the interface bracket to be attached to multiple drum carrier assembly. This same process applies to mounting the interlock bracket 39 to any other type of percussion instrument, including without limitation, cymbals, xylophones, lyres, bongos, bass drums, multi-toms, chimes, and the like.

The set of shoulder support elements 1, the horizontally mounted member 5, the upper vertical member 6, the lower vertical member 7, the belly plate 3, and the interlock mounting system C in the present embodiment is made from aluminum material. It will be appreciated by those of skill in the art that other materials may also be used. For example, any material may be used as long as the material provides sufficient stiffness to prevent the percussion instrument carrying system A from being too flexible to support or play a percussion instrument and is durable enough to function well within the environment in which drum carriers are used, which includes high temperatures, low temperatures, high humidity, low humidity, high tensile loads, high bending loads, and various vibrations frequencies.

Adjustment

The various embodiments of the percussion instrument carrying system A of the present invention provide means for allowing the musician using the percussion instrument carrying system to adjust the paying position of the percussion instrument being carried by the percussion instrument carrying system.

Figure 5:
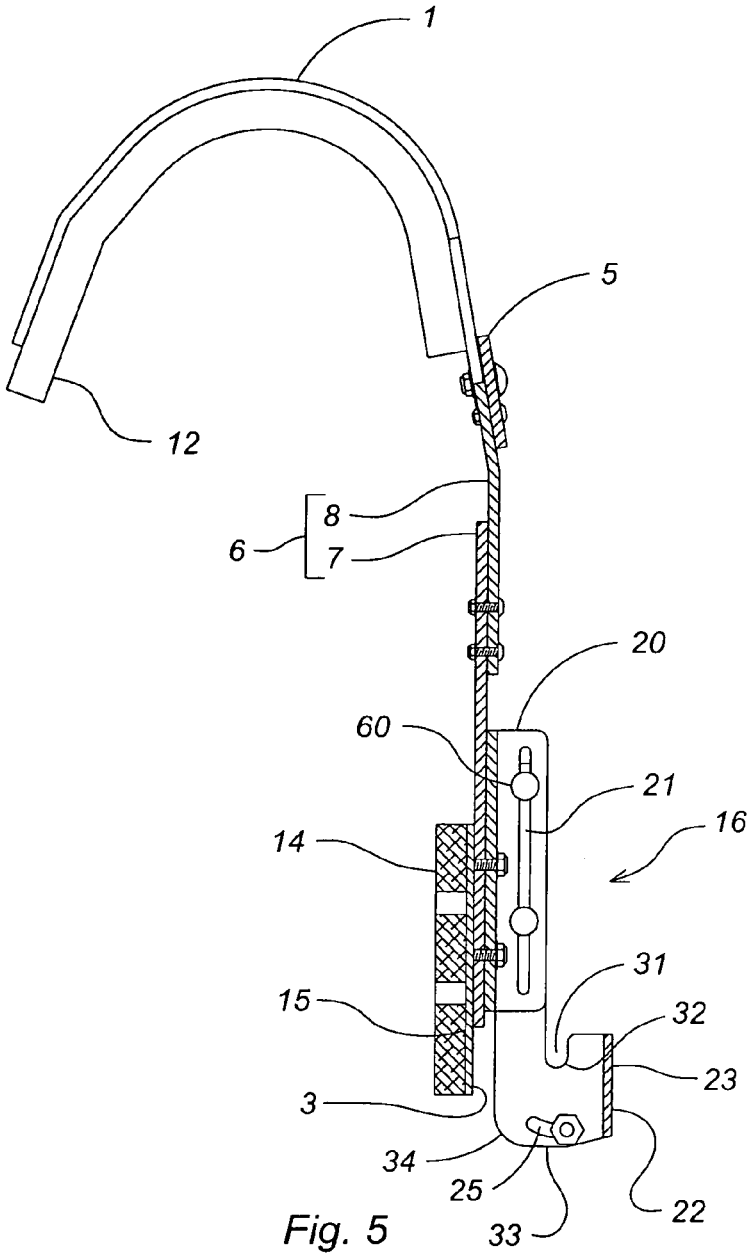
FIG. 5 shows a vertical section view the drum carrier element of one version of the interlock mounting system of the drum carrier portion of one embodiment of the present invention.

In one embodiment of the present invention as shown in FIG. 5, the vertical playing position of the percussion instrument can be made by loosening the fasteners 60 and relocating the second bracket element 22 in relation to the first bracket element 20. When the desired position of the percussion instrument is reached, the fasteners 60 are retightened to maintain the relationship between the second bracket element 22 and the first bracket element 20. The general result is the vertical positioning of the percussion instrument that the musician desires.

In addition to the ability to adjust the vertical position of the percussion instrument, the position of the horizontal plane of the playing surface 60 (FIG. 3) can also be adjusted. As shown in FIGS. 8A, 8B, and 8C, the position of the two thrust washers 44 mounted in the second bracket element 22 is dependent on where the thrust washers are in relation to the curved slotted opening 25 of the exterior bracket element. When the fasteners for holding the thrust washers 44 are loosened, the hexagonal rod 45 and the thrust washers may be relocated in the curved slotted opening 25 to allow the thrust washers to be at one end or the other of the curved slotted opening, or be adjusted to a position anywhere between the ends of the curved slotted opening. It is appreciated that the position of the two thrust washers 44 generally dictates the position of the slot 55 in the bracket 50 that rests against the thrust washers. Thus, by locating the thrust washers 44 nearest the end of the curved slotted opening 25 that is furthest from the belly plate 3, the horizontal plane of the playing surface 60 of the percussion is tilted such that the edge of the playing surface furthest away from the musician tends to be rotated toward the head of the musician. In contrast, by locating the two thrust washers 44 nearest the end of the curved slotted opening 25 that is nearest the belly plate 3, the horizontal plane of the playing surface 60 of the percussion is tilted such that the edge of the playing surface furthest away from the musician tends to be rotated away from the head of the musician. Thus, the location of the two thrust washers 44 can be used to adjust the camber of the playing surface to be either toward or away from the musician.

Mounting the Percussion Instrument onto the Percussion Instrument Carrying System A.

In a preferred embodiment of the percussion instrument carrying system A, the percussion instrument 35 is mounted onto the drum carrier portion B of the percussion instrument carrying system A by using the interlock mounting system C. Referring now to FIGS. 8A, 8B, and 8C, elements of the interlock mounting system C are engaged together to hold and substantially mount the percussion instrument 35 to the percussion instrument carrying system A. More specifically, FIG. 8A shows the starting position of the percussion instrument portion of the interlock mounting system 17 in relation to the drum carrier portion of the interlock mounting system 16. In that position, the interface bracket 39 is positioned as shown to allow the first brace rod 51 to be located within the first cutout 31 of the second bracket element 22. Then, the interface bracket 39 is rotated clockwise such that the web portion 53 of the interface bracket moves toward a more vertical position.

As the interface bracket 39 is rotated clockwise, the two thrust washers 44 of the second bracket element 22 get closer to the second cutout 55 of the interface bracket. The interface bracket 39 continues to be rotated clockwise until the second cutout 55 comes into contact with the two thrust washers 44. It is understood that during this rotation of the interface bracket 39 there is a point in time where the second brace rod 52 comes into contact with the arcuate portion 33 of the proximal end 26 of the second bracket element 22. It is also understood that the shape of the actuate portion 33 tends to bias the second brace rod 52 into the first cutout 31 of the second bracket element 22. As a result, this bias of the second brace rod 52 tends to draw the first brace rod 51 more deeply and firmly into the first cutout 31. As the interface bracket 39 is rotated, the arcuate portion 33 continues to draw the first brim rod 51 deeper into the first cutout 31 until the two thrust washers 44 contact the inside of the second cutout 55 at which time the rotation process is complete. The location, size, configuration and arrangement of the components of drum carrier portion of the interlock mounting system 16 and the components of the percussion instrument portion of the interlock mounting system 17 result in an interlocking of those elements to achieve the mounting of the percussion instrument onto the percussion instrument carrying system A.

It is noted that in an alternative embodiment as described herein, mounting the percussion instrument 35 is generally achieved as note in the previous paragraph, however, the second brace rod 52 need not contact the actuate portion 33 to bias the first brace rod 51 into the first cutout 31. Instead, the slanted edge 100 of the second cutout 55 is biased by the thrust washers 44 to in turn bias the first brace rod 51 deeper into the first cutout 31. In that alternative embodiment, the second brace rod 52 acts to resist any upward movement of the interface bracket 39 in relation to the percussion instrument carrier portion 16 of the interlock mounting system C.

While the above description describes various embodiments of the present invention, it will be clear that the present invention may be otherwise easily adapted to fit any configuration where percussion instrument carrier system is required. Additionally, as various changes could be made in the above constructions without departing from the scope of the invention, it is also intended that all matter contained in the above description or shown in the accompanying drawings shall be interpreted as illustrative and not in a limiting sense. The scope of the invention should be determined by the appended claims and their legal equivalents, rather than by the examples given.

Terms such as "upper," "lower," "inner," "outer," "inwardly," "outwardly," "exterior," "interior," and the like when used herein refer to positions of the respective elements as they are shown in the accompanying drawings, and the disclosure is not necessarily limited to such positions. Terms such as "first," "second," and other numerical terms when used herein do not imply a sequence or order unless clearly indicated by the context.

When introducing elements or features and the exemplary embodiments, the articles "a," "an," "the" and "said" are intended to mean that there are one or more of such elements or features. The terms "comprising," "including," and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It will also be understood that when an element is referred to as being "connected," "coupled," "engaged," or "engageable" to and/or with another element, it can be directly connected, coupled, engaged, engageable to and/or with the other element or intervening elements may be present. In contrast, when an element is referred to as being "directly connected," "directly coupled," "directly engaged," or "directly engageable" to another element, there are no intervening elements present. Other words used to describe the relationship between elements should be interpreted in a like fashion (e.g., "between" versus "directly between," "adjacent" versus "directly adjacent," etc.).

The foregoing description of the embodiments of the present invention has been provided for purposes of illustration and description. It is not intended to be exhaustive or to limit the invention to the precise forms disclosed. Individual elements or features of a particular embodiment are generally not limited to that particular embodiment, but, where applicable, are interchangeable and can be used in a selected embodiment, even if not specifically shown or described.

What is claimed is:

1. A percussion instrument carrier system comprising:

a percussion instrument carrier; and an interlock mounting system comprising a percussion instrument carrier portion and a percussion instrument portion wherein the percussion instrument portion operatively engages the percussion instrument carrier portion to allow one of either mounting the percussion instrument onto the percussion instrument carrier or dismounting the percussion instrument from the percussion instrument carrier by only the manipulation of the percussion instrument in relation to the percussion instrument carrier as needed to respectively and operatively engage or disengage components of the interlock mounting system, and wherein the percussion instrument carrier system has no J hooks.

2. The percussion instrument carrier system of claim 1 wherein the percussion instrument carrier portion of the interlock mounting system includes a first bracket element having a web and two flanges wherein each of the two flanges includes at least one slotted mounting opening positioned generally parallel to the longitudinal axis of the first bracket element.

3. The percussion instrument carrier system of claim 2 wherein the percussion instrument carrier portion of the interlock mounting system further comprises a second bracket element having a web portion and two flange portions wherein each of the two flange portions includes a curved slotted opening located near a proximal end of the second bracket element such that the curved slotted opening is generally perpendicular to the longitudinal surface of the flange portion, wherein a distal end of the flange portion includes at least one fastener opening sized and located to match the slotted mounting openings of the first bracket element, wherein a first cutout is located between the proximal end and the distal end of each flange portion.

4. The percussion instrument carrier system of claim 3 wherein the second bracket element is operatively disposed near the first bracket element such that the first bracket element is generally positioned between the two flange portions of the second bracket element such that the at least one fastener opening of the second bracket element generally aligns with at least one slotted mounting opening in the first bracket element and the first bracket element is fastened to the second bracket element with a set of fasteners.

5. The percussion instrument carrier system of claim 4 wherein the interlock mounting system further comprises a rod positioned between the two flanges of the first bracket element such that the rod is held in place by a set of fasteners inserted into the curved slotted openings of the first bracket element, and further comprising a set of thrust washers that are mounted onto the exterior surfaces of the two flanges of the first bracket element.

6. The percussion instrument carrier system of claim 5 wherein the percussion instrument portion of the interlock mounting system further comprises an interlock assembly, an upper bracket that is generally L-shaped having a first set of mounting openings in the first leg and a second set of mounting openings in the second leg, and a lower bracket that is also generally L-shaped and includes at least one slotted mounting opening designed to generally match the set of second mounting openings.

7. The percussion instrument carrier system of claim 6 wherein the interlock assembly further comprises an interlock receiver, a first brace rod, a second brace rod, and a set of mounting fasteners that attach the first and second brace rods to the interlock receiver.

8. The percussion instrument carrier system of claim 7 wherein the interlock receiver includes a web portion and two flanges wherein each of the two flanges has a second cutout and a slanted edge, wherein the web portion includes at least one bracket mounting opening sized and configured to substantially match the at least one slotted mounting opening and the set of second mounting openings, wherein the second cutout is shaped and configured to operatively accept the set of thrust washers that are mounted onto the two flanges of the first bracket element, and wherein the first brace rod is mounted between the two flanges of the interlock receiver and are configured and sized to be received by the cutout of the second bracket element of the carrier instrument mechanism.

9. The percussion instrument carrier system of claim 8 wherein the percussion instrument portion of the interlock mounting system is attached to a percussion instrument by mounting the upper bracket and the lower bracket onto the percussion instrument with fasteners such that the at least one slotted mounting opening of the lower bracket is substantially aligned with the second set of mounting openings of the upper bracket and the at least one bracket mounting opening in the interlock receiver.

10. The percussion instrument carrier system of claim 9 wherein the percussion instrument is mounted onto the percussion instrument carrier portion of the percussion instrument carrying system by operative engagement of the interlock mounting system such that elements of the interlock mounting system are engaged together to hold and substantially mount the percussion instrument to the percussion instrument carrier system and such that the interface bracket is positioned to allow the first brace rod to be located within the first cutout of the second bracket element, wherein the interface bracket is, rotated such that the web portion of the interface bracket moves toward a more vertical position such that the thrust washers comes into contact with the second cutout and the slanted edge of the interface bracket, and wherein during rotation of the interface bracket the second brace rod contacts the slanted edge of the second cutout such that the thrust washers tend to bias, the first brace rod into the first cutout.

11. The percussion instrument carrier system of claim 10 wherein the percussion instrument carrier comprises a T-bar assembly having a horizontally mounted member and a vertically mounted member, a belly plate, and a set of shoulder supporting elements connected to the horizontally mounted member by at least one of either a set of fasteners or by welding.

12. The percussion instrument carrier system of claim 11 wherein the set of shoulder supporting elements has a design such that the end portion of each of the set of shoulder supporting elements is set at an angle in relation to the remainder of each of the set of shoulder supporting elements such that the longitudinal axis of the end portion is set at an angle of between about 25 degrees and about 45 degrees in relation to the longitudinal axis of the remainder of each of the set of shoulder supporting elements.

13. The percussion instrument carrier system of claim 12 wherein the vertically mounted member is disposed next to the horizontally mounted member by intersecting the horizontally mounted member near the longitudinal centerline of the length of the horizontally mounted member.

14. The percussion instrument carrier system of claim 13 wherein the vertically mounted member is attached to the horizontally mounted member by at least one of either a set of fasteners or by welding.

15. The percussion instrument carrier system of claim 14 wherein the vertically mounted member comprises more than a single continuous element such that the vertically mounted member is a sub-assembly comprising two or more sub-members that can work operatively together to allow for adjustment of the percussion instrument carrier.

16. The percussion instrument carrier system of claim 15 wherein the vertically mounted member is a subassembly comprising an upper vertical member and a lower vertical member having a first set of mounting openings that substantially matches a second set of mounting openings located in the upper vertical member such that the spacing between each of the openings in the first set of mounting openings is substantially the same as the spacing between the openings in the second set of mounting openings.

17. The percussion instrument carrier system of claim 16 wherein the vertically mounted member is disposed near the belly plate by placing a lower portion of the vertically mounted member near the belly plate and the belly plate is attached to the vertically mounted member by at least one of either a set of fasteners or by welding.

18. The percussion instrument carrier system of claim 17 further comprising a shoulder support element pad mounted to an underside surface of each of the shoulder supporting element.

19. The percussion instrument carrier system of claim 18 further comprising a belly plate pad mounted onto an inner surface of the belly plate.

20. The percussion instrument carrier system of claim 19 wherein the shoulder support element pad and the belly plate pad are made from a generally resilient material that is one of either a closed cell foam or an open cell foam material.

21. The percussion instrument carrier system of claim 20 wherein the shoulder support element pad and the belly plate pad are attached by one of either an adhesive or a hook and loop fastener system.

22. The percussion instrument carrier system of claim 21 wherein shoulder support element pad is shaped such that the ends of the shoulder support pad generally match the width of the shoulder supporting element while being dimensionally wider than the width of the shoulder support element at the point where the shoulder support element rest upon an upper shoulder of a user of the percussion instrument carrying system.

23. The percussion instrument carrier system of claim 1 wherein the percussion instrument portion of the interlock mounting system is operatively connected to a percussion instrument in a manner that allows the percussion instrument portion of the interlock mounting system to operatively engage with the percussion instrument carrier portion of the interlock mounting system, wherein certain elements of the percussion instrument portion of the interlock mounting system are designed to match and generally interlock with related elements of the percussion instrument carrier portion of the interlock mounting system, and wherein the interlock mounting system inhibits the percussion instrument from being dismounted from the percussion instrument carrier by only a generally upward movement of the percussion instrument.

24. The percussion instrument carrier system of claim 23 wherein the percussion instrument can only be dismounted from the percussion instrument carrier by rotating the percussion instrument in relation to the percussion instrument carrier.

25. A percussion instrument carrier system comprising:

a percussion instrument carrier having a vertically mounted member attached to a horizontally mounted member to generate a T-shaped assembly wherein the vertically mounted member comprises an upper vertical member adjustably connected to a lower vertical member;

a set of shoulder supporting elements connected to the horizontally mounted member;

a belly plate mounted to the lower vertical member; and an interlock mounting system comprising a percussion instrument carrier portion and a percussion instrument portion wherein the percussion instrument portion operatively engages the percussion instrument carrier portion to allow one of either mounting the percussion instrument onto the percussion instrument carrier or dismounting a percussion instrument from the percussion instrument carrier by the manipulation of the percussion instrument in relation to the percussion instrument carrier as needed to respectively and operatively engage or disengage components of the interlock mounting system wherein the percussion instrument can only be dismounted from the percussion instrument carrier by rotating the percussion instrument in relation to the percussion instrument carrier, and wherein the percussion instrument carrier system has no J hooks.

26. The percussion instrument carrier system of claim 25 wherein the percussion instrument carrier portion comprises a first adjustment element attached to the T-shaped assembly and a second adjustment element slideably engaged with the first adjustment element wherein the second adjustment element is sized and configured to include an engagement system that engage with the percussion instrument portion of the interlock mounting system.

27. A percussion instrument carrier system comprising:

a percussion instrument carrier; and means for mounting a percussion instrument onto the percussion instrument carrier wherein the means includes the capability of one of either mounting the percussion instrument onto the percussion instrument carrier or dismounting the percussion instrument from the percussion instrument carrier by only the manipulation of the percussion instrument in relation to the percussion instrument carrier as needed to respectively and operatively engage or disengage components of the interlock mounting system, wherein the percussion instrument can only be dismounted from the percussion instrument carrier by rotating the percussion instrument in relation to the percussion instrument carrier, and wherein the percussion instrument carrier system has no J hooks.

28. A percussion instrument carrier system comprising:

a percussion instrument carrier; and an interlock mounting system comprising a percussion instrument carrier portion and a percussion instrument portion that operatively engages the percussion instrument carrier portion using a cam lock-like mechanism configured to allow the percussion instrument portion to interlock with the percussion instrument carrier portion in a manner that allows one of either mounting the percussion instrument onto the percussion instrument carrier or dismounting the percussion instrument from the percussion instrument carrier by only the manipulation of the percussion instrument in relation to the percussion instrument carrier as needed to respectively and operatively engage or disengage components of the interlock mounting system wherein the percussion instrument can only be dismounted from the percussion instrument carrier by rotating the percussion instrument in relation to the percussion instrument carrier, and wherein the percussion instrument carrier system has no J hooks.

29. The percussion instrument carrier system of claim 28 wherein the percussion instrument carrier portion of the interlock mounting system further comprises:

a first bracket element having two flanges and a web wherein each of the two channel flanges includes at least one slotted mounting opening positioned generally parallel to the longitudinal axis of the first bracket element;

a second bracket element having a web portion and two flange portions wherein each of the two flange portions includes a curved slotted opening located near a proximal end of the second bracket element such that the curved slotted opening is generally perpendicular to the longitudinal surface of the flange portion, wherein a distal end of the flange portion includes at least one fastener opening sized and located to match the slotted mounting openings of the first bracket element, wherein a first cutout is located between the proximal end and the distal end of each flange portion, wherein the proximal end of the flange portions also includes a generally arcuate portion that extends from an outer edge to the point of intersection of the flange portion with the web portion such that the arcuate portion has a general cam-like shape where the more linear segment of the cam-like shape occurs near the intersection point of the flange portion with the web portion while the smaller radius portion of the cam-like shape occurs at the outer edge of the flange portion; and wherein the second bracket element is disposed near the first bracket element such that the interior channel element is generally positioned between the two flange portions of the second bracket element such that the at least one fastener opening of the second bracket element generally aligns with the at least one slotted mounting opening in the first bracket element, and wherein the first bracket element is fastened to the second bracket element with a set of fasteners.

30. The percussion instrument carrier system of claim 29 wherein the interlock mounting system further comprises:

a rod positioned between the two flanges of the second bracket element such that the rod is held in place by a set of fasteners inserted into the curved slotted openings of the first bracket element, and further comprising a set of thrust washers mounted onto the two flanges of the second bracket element; and, an interlock assembly, an upper bracket that is generally L-shaped having a first set of mounting openings in the first leg and a set of second mounting openings in the second leg, and a lower bracket that is also generally L-shaped and includes at least one slotted mounting opening designed to generally match the set of second mounting openings, wherein the interlock assembly includes an interlock receiver, a first brace rod, a second brace rod, and a set of mounting fasteners that attach the first and second brace rods to the interlock receiver, wherein the interlock receiver is generally channel-shaped having a web portion and two flanges having a second cutout and a slanted edge, wherein the web portion includes at least one bracket mounting opening sized and configured to substantially match the at least one slotted mounting opening and the set of second mounting openings, wherein the second cutout is shaped and configured to operatively accept the set of thrust washers that are mounted onto the two flanges of the second bracket element, and wherein the first brace rod is mounted between the two flanges of the interlock receiver and is configured and sized to be received by cutout of the second bracket element of the percussion carrier portion, and the second brace rod is configured and sized to slideably interface with the arcuate portion of the second bracket element.

31. The percussion instrument carrier system of claim 30 wherein the percussion instrument portion of the interlock mounting system is attached to a percussion instrument by mounting the upper bracket and the lower bracket onto the percussion instrument with fasteners such that the at least one slotted mounting opening of the lower bracket is substantially aligned with the second set of mounting openings of the upper bracket and the at least one bracket mounting opening in the interlock receiver.

32. The percussion instrument carrier system of claim 31 wherein the percussion instrument carrier comprises a T-bar assembly having a horizontally mounted member and a vertically mounted member, and a belly plate, and a set of a shoulder supporting elements connected to the horizontally mounted member by at least one of either a set of fasteners or by welding.

33. The percussion instrument carrier system of claim 32 wherein the percussion instrument is mounted onto the percussion instrument carrier portion of the percussion instrument carrying system by operative engagement of the interlock mounting system such that elements of the interlock mounting system are engaged together to hold and substantially mount the percussion instrument to the percussion instrument carrying system wherein the interface bracket is positioned to allow the first brace rod to be located within the first cutout of the second bracket element, wherein the interface bracket is rotated such that the web portion of the interface bracket moves toward a more vertical position such that the thrust washers comes into contact with the second cutout of the interface bracket, wherein during rotation of the interface bracket the second brace rod contacts the arcuate portion of the proximal end of the second bracket element and the shape of the actuate portion tends to bias the second brace rod into the first cutout of the second bracket element to thereby draw the first brace rod more deeply and firmly into the first cutout.

34. The percussion instrument carrier system of claim 33 wherein the percussion instrument portion of the interlock mounting system is operatively connected to the percussion instrument in a manner that allows the percussion instrument portion of the interlock system to operatively engage with the percussion instrument carrier portion of the interlock mounting system wherein certain elements of the percussion instrument portion of the interlock mounting system are designed to match and generally interlock with related elements of the percussion instrument carrier portion of the interlock mounting system.

35. The percussion instrument carrier system of claim 34 wherein the set of shoulder supporting elements are configured such that the end portion of each of the set of shoulder supporting elements is set at an angle in relation to the remainder of each of the set of shoulder supporting elements such that the longitudinal axis of the end portion is set at an angle of between about 25 degrees and about 45 degrees in relation to the longitudinal axis of the remainder of each of the set of shoulder supporting elements.

36. The percussion instrument carrier system of claim 35 wherein the vertically mounted member is disposed next to the horizontally mounted member by intersecting the horizontally mounted member near the longitudinal centerline of the length of the horizontally mounted member.

37. The percussion instrument carrier system of claim 36 wherein the vertically mounted member is attached to the horizontally mounted member by at least one of either a set of fasteners or by welding.

38. The percussion instrument carrier system of claim 37 wherein the vertically mounted member comprises more than a single continuous element such that the vertically mounted member is a sub-assembly comprising two or more submembers that can work operatively together to allow for adjustment of the percussion instrument carrier.

39. The percussion instrument carrier system of claim 38 wherein the vertically mounted member is a subassembly comprising an upper vertical member and a lower vertical member having a first set of mounting openings that substantially matches a second set of mounting openings located in the upper vertical member such that the spacing between each of the openings in the first set of mounting openings is substantially the same as the spacing between the openings in the second set of mounting openings.

40. The percussion instrument carrier system of claim 39 wherein the vertically mounted member is disposed near the belly plate by placing a lower portion of the vertically mounted member near the belly plate and the belly plate is attached to the vertically mounted member by at least one of either a set of fasteners or by welding.

41. The percussion instrument carrier system of claim 40 further comprising a shoulder support element pad mounted to an underside surface of the shoulder supporting element.

42. The percussion instrument carrier system of claim 41 further comprising a belly plate pad mounted onto an inner surface of the belly plate capable of resting next to the abdomen of a percussionist using the percussion instrument carrying system.

43. The percussion instrument carrier system of claim 42 wherein the shoulder support element pad and the belly plate pad are made from a generally resilient material that is one of either a closed cell foam or an open cell foam material.

44. The percussion instrument carrier system of claim 43 wherein the shoulder support element pad and the belly plate pad are attached by one of either an adhesive or a hook and loop fastener system.

45. The percussion instrument carrier system of claim 44 wherein shoulder support element pad is shaped such that the ends of the shoulder support padding generally match the width of the shoulder supporting element while being dimensionally wider than the width of the shoulder support element at the point where the shoulder support element rest upon an upper shoulder of a user of the percussion instrument carrying system.

46. A percussion instrument carrier system comprising:

a percussion instrument carrier having a vertically mounted member attached to a horizontally mounted member to generate a T-shaped assembly wherein the vertically mounted member comprises an upper vertical member adjustably connected to a lower vertical member;

a set of shoulder supporting elements connected to the horizontally mounted member;

a belly plate mounted to the lower vertical member; and a percussion instrument carrier portion and a percussion instrument portion that operatively engages the percussion instrument carrier portion by using a cam lock-like mechanism configured to allow the percussion instrument portion to interlock with the percussion instrument carrier portion in a manner that allows one of either mounting the percussion instrument onto the percussion instrument carrier or dismounting the percussion instrument from the percussion instrument carrier by only the manipulation of the percussion instrument in relation to the percussion instrument carrier as needed to respectively and operatively engage or disengage components of the interlock mounting system, wherein the percussion instrument can only be dismounted from the percussion instrument carrier by rotating the percussion instrument in relation to the percussion instrument carrier, and wherein the percussion instrument carrier system has no J hooks.

47. The percussion instrument carrier system of claim 46 wherein the percussion instrument carrier portion comprises a first adjustment element attached to the T-shaped assembly and a second adjustment element slideably engaged with the first adjustment element wherein the second adjustment element is sized and configured to include an arcuate surface that engages with the percussion instrument portion of the interlock mounting system in a generally cam lock-like manner.

48. A percussion instrument carrier system comprising:

a percussion instrument carrier; and means for mounting a percussion instrument onto the percussion instrument carrier wherein the means includes an interlock mounting system having a percussion instrument carrier portion and a percussion instrument portion that operatively engages the percussion instrument carrier portion using a cam lock-like mechanism configured to allow the percussion instrument portion to interlock with the percussion instrument carrier portion in a manner that allows one of either mounting the percussion instrument onto the percussion instrument carrier or dismounting the percussion instrument from the percussion instrument carrier by only the manipulation of the percussion instrument in relation to the percussion instrument carrier as needed to respectively and operatively engage or disengage components of the interlock mounting system, and wherein the percussion instrument carrier system has no J hooks.

49. The percussion instrument carrier system of claim 48 wherein the percussion instrument can only be dismounted from the percussion instrument carrier by rotating the percussion instrument in relation to the percussion instrument carrier.

* * * * *